US005254026A

United States Patent [19]

Kaiser

[11] Patent Number: 5,254,026

[45] Date of Patent: Oct. 19, 1993

[54] BALLOON DISPLAY DEVICE

[76] Inventor: Frederick H. Kaiser, 503 Peachtree Ct., Crystal Lake, Ill. 60014

[21] Appl. No.: 914,920

[22] Filed: Jul. 17, 1992

Related U.S. Application Data

[63] Continuation-in-part of Ser. No. 788,597, Jan. 6, 1992, abandoned.

[51] Int. Cl.[5] ..... A63H 3/06; A63H 3/00; A47G 1/06; B65D 81/02

[52] U.S. Cl. ..... 446/220; 446/73; 40/159; 40/214; 206/522; 383/3

[58] Field of Search ..... 446/73, 220, 221, 222, 446/223, 224, 225, 226; 40/159, 124.2, 212, 214; 206/522; 383/3

[56] References Cited

U.S. PATENT DOCUMENTS

| | | | |
|---|---|---|---|
| 3,771,247 | 11/1973 | DeHarak | 446/221 X |
| 3,940,778 | 2/1976 | Craig et al. | 40/159 X |
| 4,015,111 | 3/1977 | Spector | 446/220 X |
| 4,155,453 | 5/1979 | Ono | 383/3 X |
| 4,190,158 | 2/1980 | Ambrose | 206/522 |
| 4,240,556 | 12/1980 | Field | 383/3 X |
| 4,262,801 | 4/1981 | Avery | 383/3 X |
| 4,811,841 | 3/1989 | Domenichiello | 206/522 X |
| 4,837,955 | 6/1989 | Grabhorn | 446/220 X |
| 4,898,561 | 2/1990 | Nottingham et al. | 446/226 X |
| 5,102,364 | 4/1992 | Rubiatowicz | 446/220 |

*Primary Examiner*—David N. Muir
*Attorney, Agent, or Firm*—Mathew R. P. Perrone, Jr.

[57] ABSTRACT

A display device, usually in the form of a balloon has at least transparent section capable of displaying an article within the balloon therethrough. The display device has a pocket within the balloon hold a removable item and display the item through the balloon. A removable sealing tape secures the pocket and a removable item within the balloon.

13 Claims, 6 Drawing Sheets

BALLOON DISPLAY DEVICE

CROSS-REFERENCE TO RELATED APPLICATIONS

This application is a continuation in part application of U.S. patent application 07/788,597 filed Jan. 6, 1992, abandoned, by the same inventor.

This invention relates to a balloon display device and more particularly to a balloon having a transparent section capable of displaying an article contained in a pocket within the balloon through the side of the balloon.

BACKGROUND OF THE INVENTION

A balloon has many uses. One of a balloon's many uses is as a display device. It is also a well-known toy for a child. A balloon or a group of balloons is also used as a gift for either an adult or a child. A balloon is decorative and entertaining, which adds to its gift quality.

A balloon may also be informative. The information can include advertising for products or appropriate directions or any other suitable function for information. A balloon can attract attention. With this attention, the directions or decorations or other information are observed, and either enjoyed or followed by a person.

Because of this wide flexibility in the use of a balloon, it is desirable to have a balloon that has additional features, to provide a multiplicity of uses therefor. It is very useful if the same balloon can be used for either directions or decorations or other matters, by merely making a simple change therein. Then, a single style of balloon can be stocked and the appropriate information, photograph, or direction can be inserted in the balloon as desired.

An especially useful display is an illusion such as a-ship-in-the-bottle. This type of illusion is difficult to create. Yet it is a very artistic and highly attractive illusion. It is desirable to simplify such an illusion.

It is difficult to achieve this flexibility factor. Not only must the balloon hold the inflating gas, it must also permit the information or decoration to be inserted therein properly. With such an insertion, the desired results can be obtained. Flexibility and mobility within the balloon for the decoration or directions is also desired. This is a difficult objective to achieve in a balloon in and of itself.

SUMMARY OF THE INVENTION

Accordingly, among the many objectives of this invention is the provision of a display device having a wide variety of uses.

A further objective of this invention is to provide a display device of simple construction.

A still further objective of this invention is to provide a display device of inexpensive construction.

Yet a further objective of this invention is to provide a long lasting display device.

Also an objective of this invention is to provide a display device capable of receiving a variety of articles.

Another objective of this invention is to provide a display device, which is easily inflatable.

Yet another objective of this invention is to provide a light-weight, display device.

Still another objective of this invention is to provide a transparent display device, whose items swing freely inside.

A further objective of this invention is to provide an illusion similar to the ship-in-a-bottle illusion in simpler fashion.

A still further objective of this invention is to provide a decorative display device.

These and other objectives of the invention (which other objectives become clear by consideration of the specification, claims and drawings as a whole) are met by providing a display device, which includes a balloon having a transparent portion. A loose, hinged top pocket is within the balloon to hold a removable item and display the item through the balloon. A flap removably secures the pocket and item contained therein within the balloon due removable sealing tape for the pocket.

BRIEF DESCRIPTION OF THE DRAWINGS

FIG. 7 depicts a side perspective view of assembled two-piece balloon 200 of this invention, the assembled pocket balloon 100 being similar.

Throughout the figures of the drawings, where the same part appears in more than one figure of the drawings, the same number is applied thereto.

DESCRIPTION OF THE PREFERRED EMBODIMENTS

Figure 1:
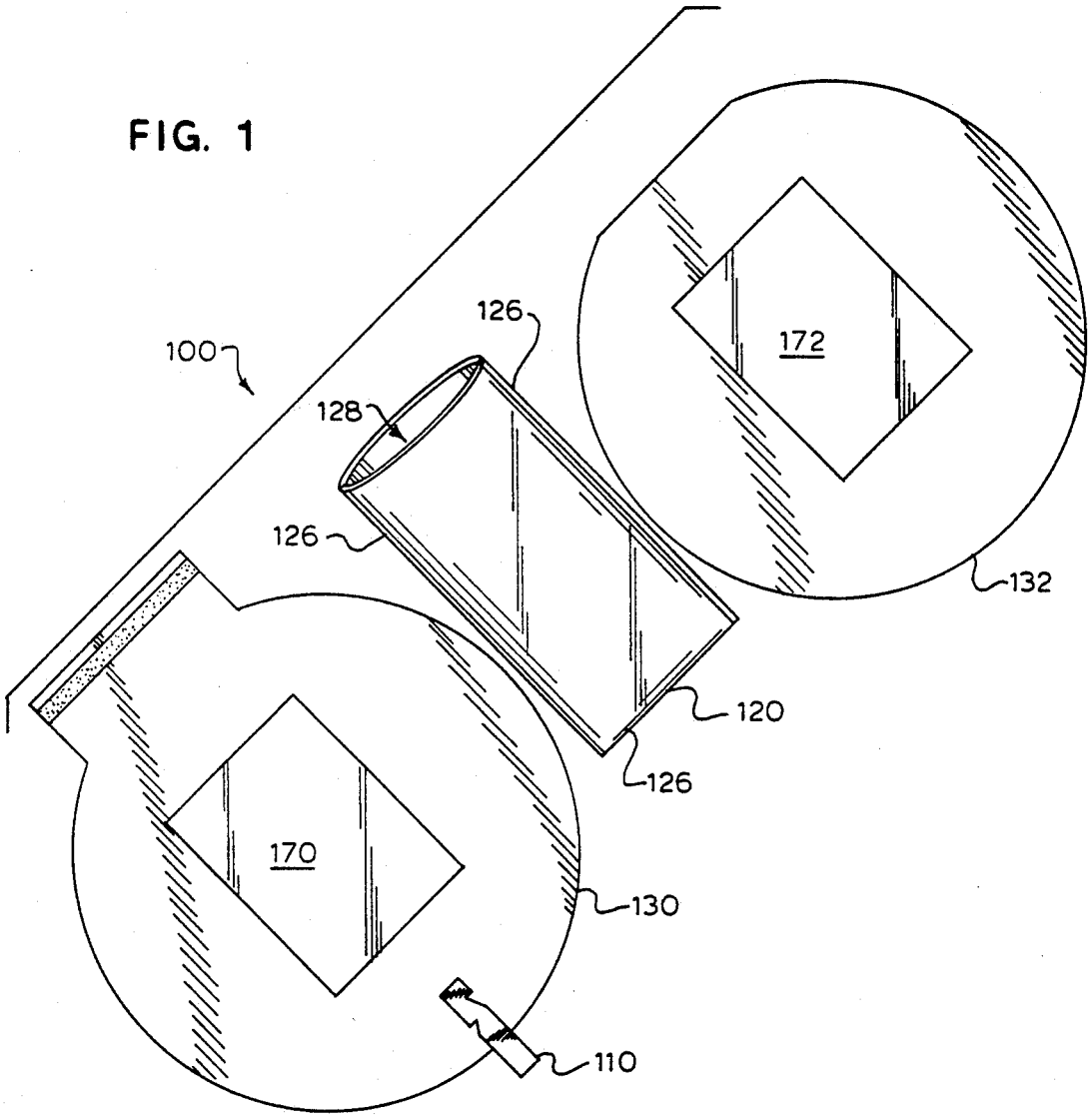
FIG. 1 depicts an exploded view of the pocket balloon 100 of this invention mounted.

A display device can show many different items. The display device includes a balloon for displaying an item. The balloon has a pocket formed therein. The pocket can receive any desired item for display inside the balloon, whether the item be decorative, informative or both.

Many methods exist for forming the pocket in a balloon. With one method, a pocket may be inserted into the balloon and heat sealed therein. While this method is operable and efficient in many instances, it has a problem in that it may be necessary to heat seal four or more layers of material. As material thickness increases, the difficuly of obtaining a proper heat seal increases.

Also, the balloon in and of itself may be formed of two pieces with adjoining extendable flaps. When the outer edge of one piece is heat sealed to the other piece, the flaps form a pocket which may be inserted inside the balloon. This procedure avoids sealing four layers and provides for simplified construction of the display device.

A plastic balloon shape with a heat sealed plastic inner pocket and a double coated tape on the flap on the front side of the outer bag that when taped and inflated is designed to display articles for viewing either indoors or outdoors. When an article is placed inside the inner pocket of the outer bag of the display device, the front side of the outer bag has a flap to which a double sided tape is adhered.

After the balloon with the pocket is formed in either fashion, an outer flap is heat-sealed or otherwise secured over the pocket slot. Preferably, the flap is first heat-sealed to the front panel of the balloon. Then the flap may be folded over the pocket slot and taped to the back panel of the balloon. The reverse procedure is operable, but not preferred.

The flap is preferred to be over the front to create the ship-in-a-bottle illusion. With the flap secured to the front panel, it is not immediately clear how the displayed item has been inserted in the balloon.

When the protective tab is removed from the double-sided tape and then folded over to the backside of the outer bag, it both additionally seals the balloon from outside elements, and prevents the inner pocket from popping out from inside pressure when air or other substance is used to inflate the outer bag. At the bottom of the display device is a self sealing valve that after inflation the air is sealed inside the outer bag. The article in the balloon is now ready to be displayed.

This balloon can be mailed with ease in a deflated position with or without an article inserted in the inner pocket. The person receiving the balloon with the pocket can insert an article if necessary of choice in the pocket. The display device or balloon, because of its unique design, can than be sealed and inflated without the need of any special equipment.

This display device, when inflated, automatically displays a centered dimensional view of a variety of any article contained therein such as photographs, pictures, or objects from the front side, backside, or multiple sides. The display device can then resemble a glass or ridged plastic globe.

The display device, when inflated, is light weight, clear, longlasting, printable, reasealable and mobile. It can be displayed by hanging, sitting, or adhered to a wall indoors or outdoors.

Because of this device, a plastic balloon shape may be used as a way of displaying an article, (for example a photograph) in simple, yet decorative manner, while requiring no special heat sealing equipment or vacuum pumps. The whole concept and application of this display device is used for a visual display indoors or outdoors similar to a dimensional glass enclosed picture frame. This present device has a variety of uses. There is no other device on the market that uses this concept.

At any rate, no matter how the pocket is formed, a flap is secured to the balloon adjacent the pocket and capable of covering and sealing the balloon, thereby enclosing, protecting and holding the pocket in the balloon. The flap is heat sealed on one side thereof and tapable or otherwise removably securable on the other side thereof. The secondary securing mechanism may also be permanent.

Using the two sheets, to form the pocket, provides for heat sealing only through two layers. With the pocket added into a slotted balloon it is sometimes necessary to heat seal through four layers to achieve the desired results.

The pocket may be of any suitable shape as desired. If a flat item is inserted in the pocket, the flat item is held in position in the pocket by inward air pressure of the inflated balloon, thereby achieving a laminated look. The balloon may have two transparent apertures on opposing sides so that photographs or similar flat items may be placed in the pocket back to back and have a two sided display. Additionally, with the pocket swinging freely in the balloon, lifelike action may be provided to the display.

If it is desired to have a three dimensional display, a blister pack in the shape of the pocket may be placed therein and whatever is desired inserted in the pocket to avoid crushing the same from the inward air pressure. This can be achieved for flowers where the pocket is generally V-shaped, or for a stuffed animal or similar decoration wherein crushing of the displayed item is not an option. The flap also keeps rain and other foreign matter out of the balloon, as well as holds the pocket within the balloon.

With a flat item in the pocket, this particular structure has only two layers of film between the eyes of a viewer and the object contained in the pocket. This structure provides an efficient, very clear and dimensional way of displaying something within the balloon. Of course, the balloon contains a single self-sealing valve, or other suitable valve, which permits inflating of the balloon by air, helium, other gas medium, liquid medium or combinations thereof.

There is also a tab, preferably a pressure-sensitive tab, on the top of the balloon which permits the balloon to be secured to a wall or other suitable surface for proper positioning. In this fashion, the desired results can be obtained. It is thus possible to mail or otherwise transport the display device, such as a balloon, in a deflated condition with or without an article in the inner pocket.

With a pocket-including balloon, the inner pocket and the outer bag can both have a variety of different shapes and sizes. Typical pocket shapes include, but are not limited to, a rectangle, a square, a triangle, a cone, a pyramid and a circle. The inner pocket does not necessarily have the same shape as the outer bag. An example of this difference is that the outward appearance of the pocket balloon can be circular and the inner pocket is rectanglar. Because of the single valve, it is possible to manufacture a wide range of shapes and sizes and correlate between the inner pocket and outer balloon.

Referring now to FIG. 1, pocket balloon 100 is shown in an exploded fashion. Pocket balloon 100 has a separate pocket 120 formed therein. The separate pocket 100 can receive any desired item for display inside pocket balloon 100, whether it be decorative, informative or both. Pocket balloon 100 has a front side 130 and a congruent rear side 132 oppositely disposed therefrom.

Figure 2:
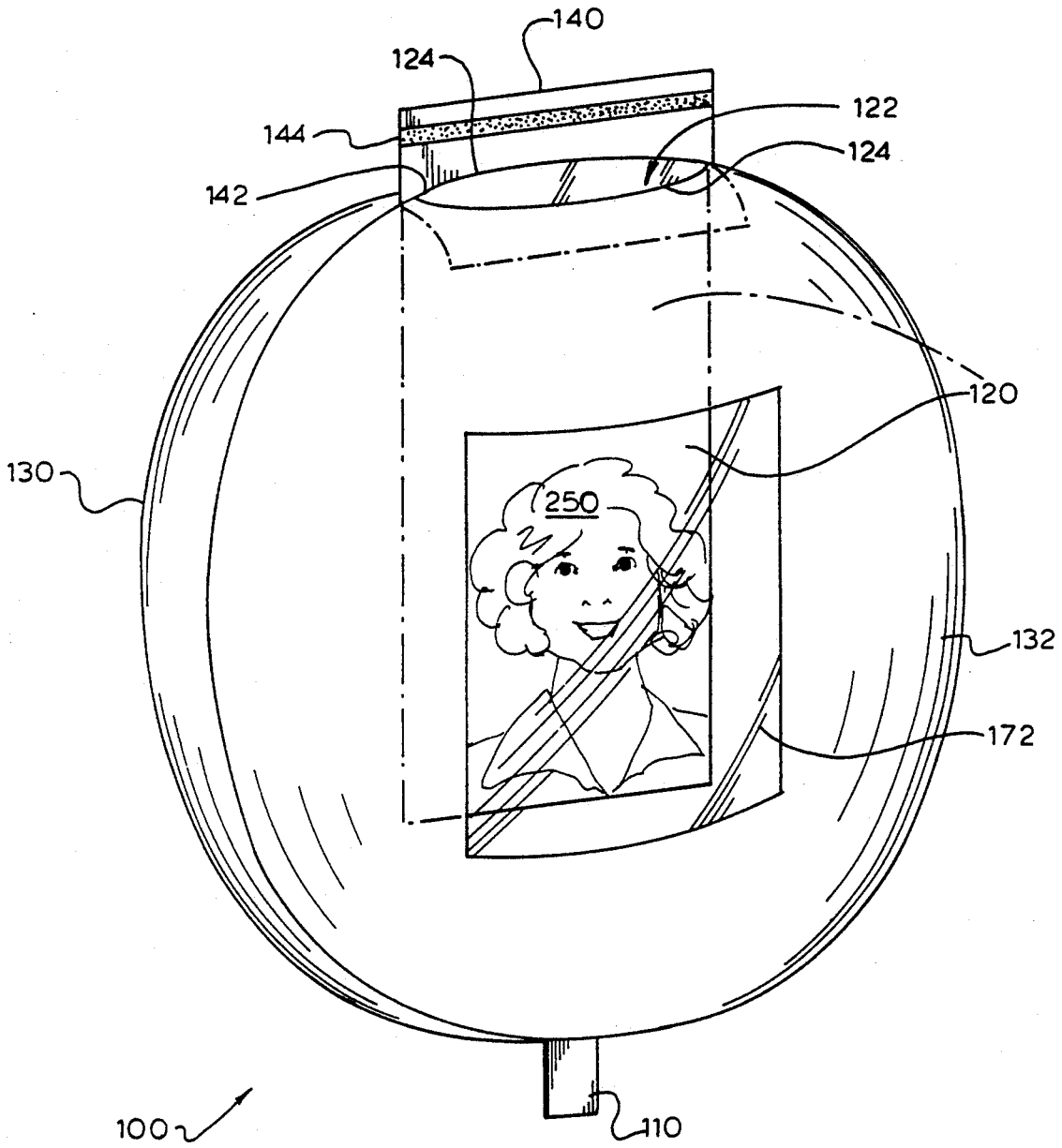
FIG. 2 depicts an isometric and perspective front view of the pocket balloon 100 of this invention, illustrating insertion of flat display 270 therein.

By adding FIG. 2 to this consideration, the use or uses of pocket balloon 100 becomes clear. As front side 130 and rear side 132 are sealed together, an inflation valve 110 is incorporated therein to provide for air to enter and inflate rear side 132 relative to front side 130. Inflation valve 110 is a self-sealing valve or other suitable valve for admitting an inflation medium, such a gas or a liquid or both into the balloon 100.

Oppositely disposed from inflation valve 110 is pocket slot 122. Pocket slot 122 is caused by leaving a portion a rear side 132 unsealed to front side 130. Separate pocket 120 is both inserted in pocket slot 122 and heat sealed or otherwise secured to pocket edges 124 of pocket slot 122. This feature closes pocket balloon 120, while leaving the pocket slot 122 open, and renders pocket balloon 100 air tight.

Separate pocket 120 has three sealed edges 126 and an open end 128. Open end 128 is sealed to edges 124 so that separate pocket 120 is within pocket balloon 100 and seals pocket balloon 100 to render the same substantially gas impervious, but for valve 110.

Figure 3:
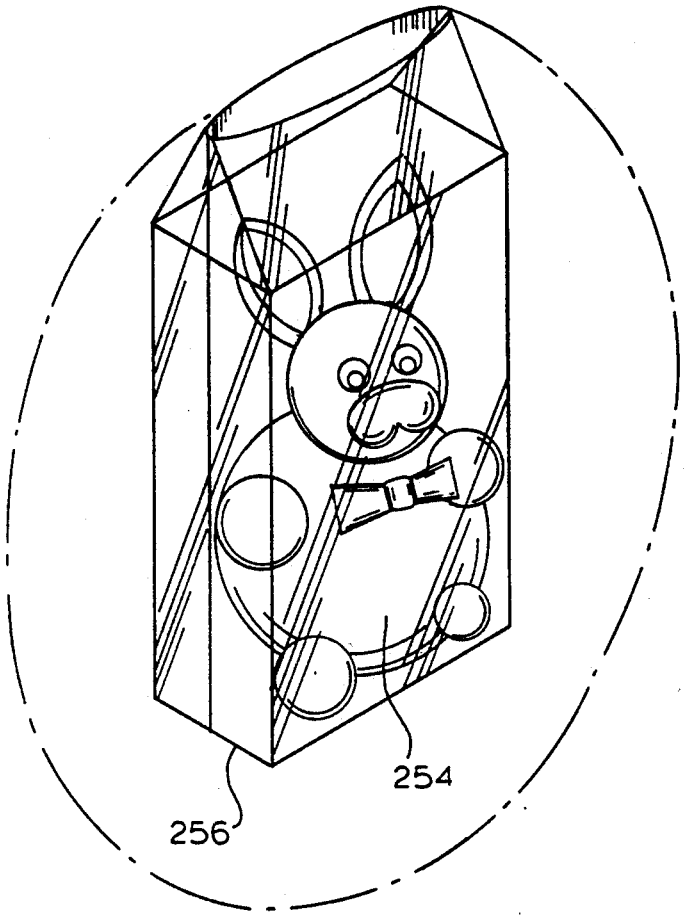
FIG. 3 depicts a perspective view of the pocket balloon 100 of this invention in phantom, with a rectangular blister pack 256 for toy 254 therein.
Figure 4:
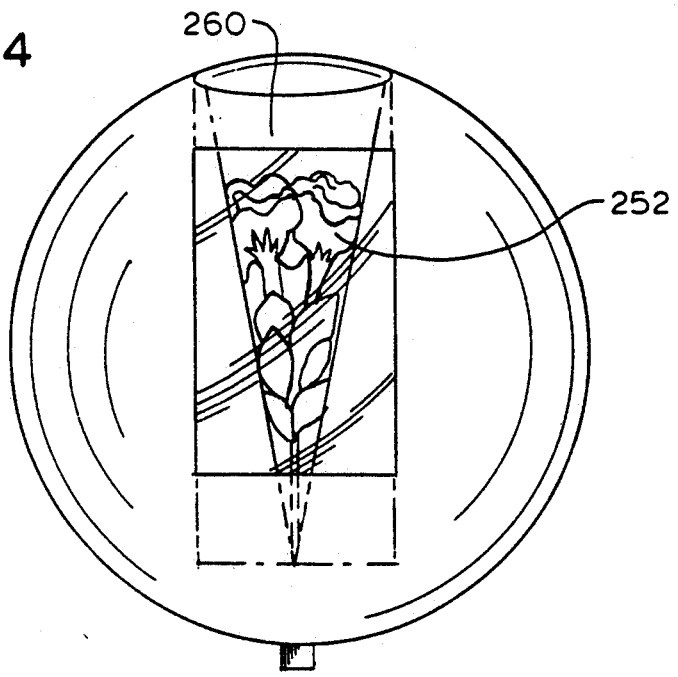
FIG. 4 depicts a front view of assembled two-piece balloon 200 of this invention, with a conical, three-dimensional display 272 therein.

With consideration of FIG. 2, FIG. 3 and FIG. 4, pocket flap 140 has a clear function. Pocket flap 140 preferably has a heat sealed edge 142 and a tape sealed edge 144 oppositely disposed therefrom. Heat sealed edge 142 is permanent and secured to either front side 130 (as shown) or rear side 132. It possible to replace heat sealed edge 142 with tape, but the heat seal is preferred, due testing proving it to be the most successful at holding the pocket in the balloon.

Pocket flap 140 has a tape sealed edge 144, as above-stated. Tape sealed edge 144 is capable of removably sealing to rear side 132 to close pocket slot 122 and hold any displayed item and pocket within the balloon. Pocket flap 140 also has the ability to keep separate pocket 120 free of anything undesired.

While this method of forming pocket balloon 100 is operable and efficient in many instances, there is a possible difficulty in that, with pocket balloon 100, it may be necessary to heat seal four or more layers of material. As material thickness increases, obtaining a strong, leak-proof, heat seal greatly increases in difficulty.

Figure 5:
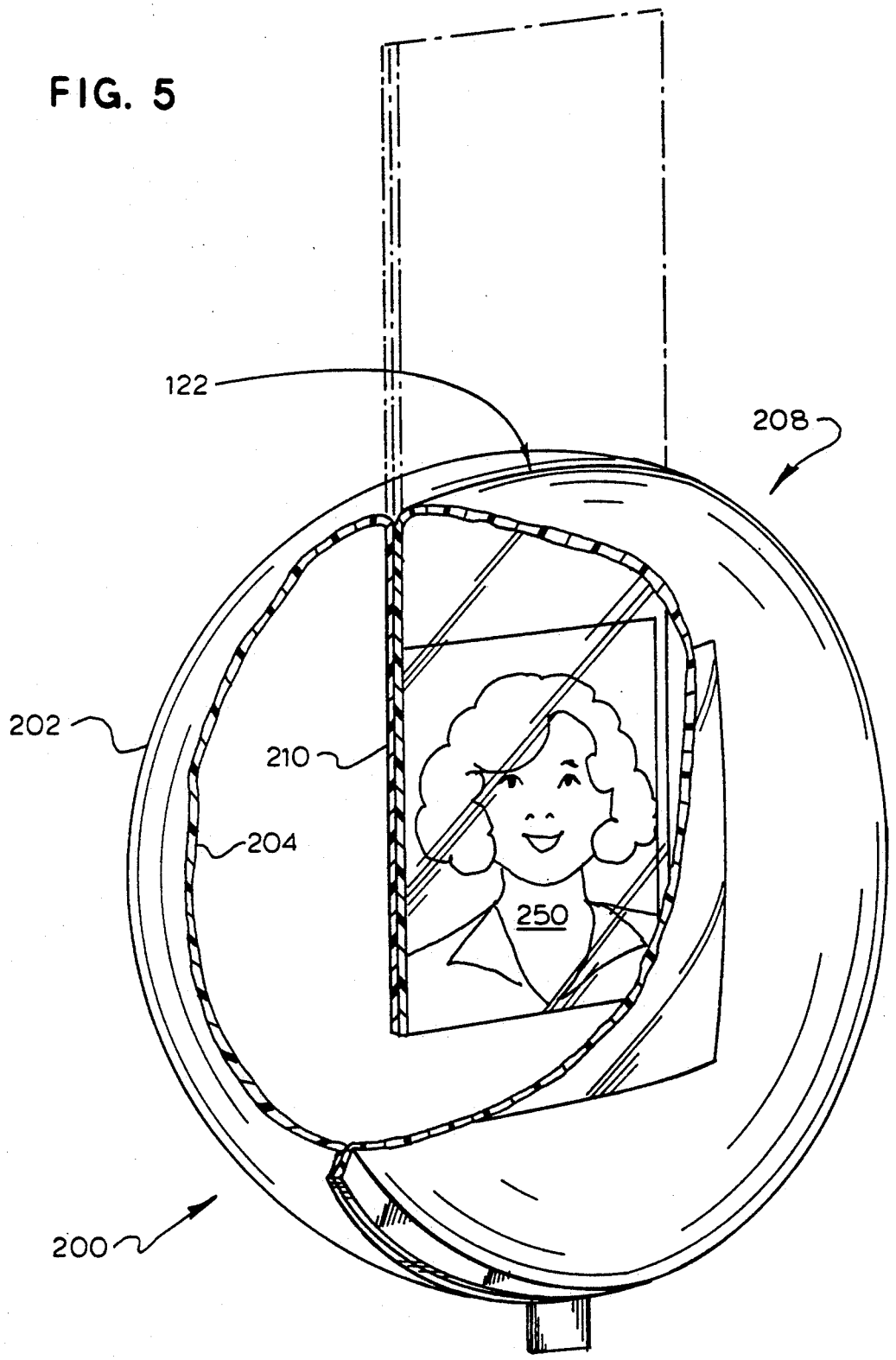
FIG. 5 depicts a perspective, partially-cutaway view of two-piece balloon 200 of this invention, showing a flat display 270 being inserted therein.
Figure 6:
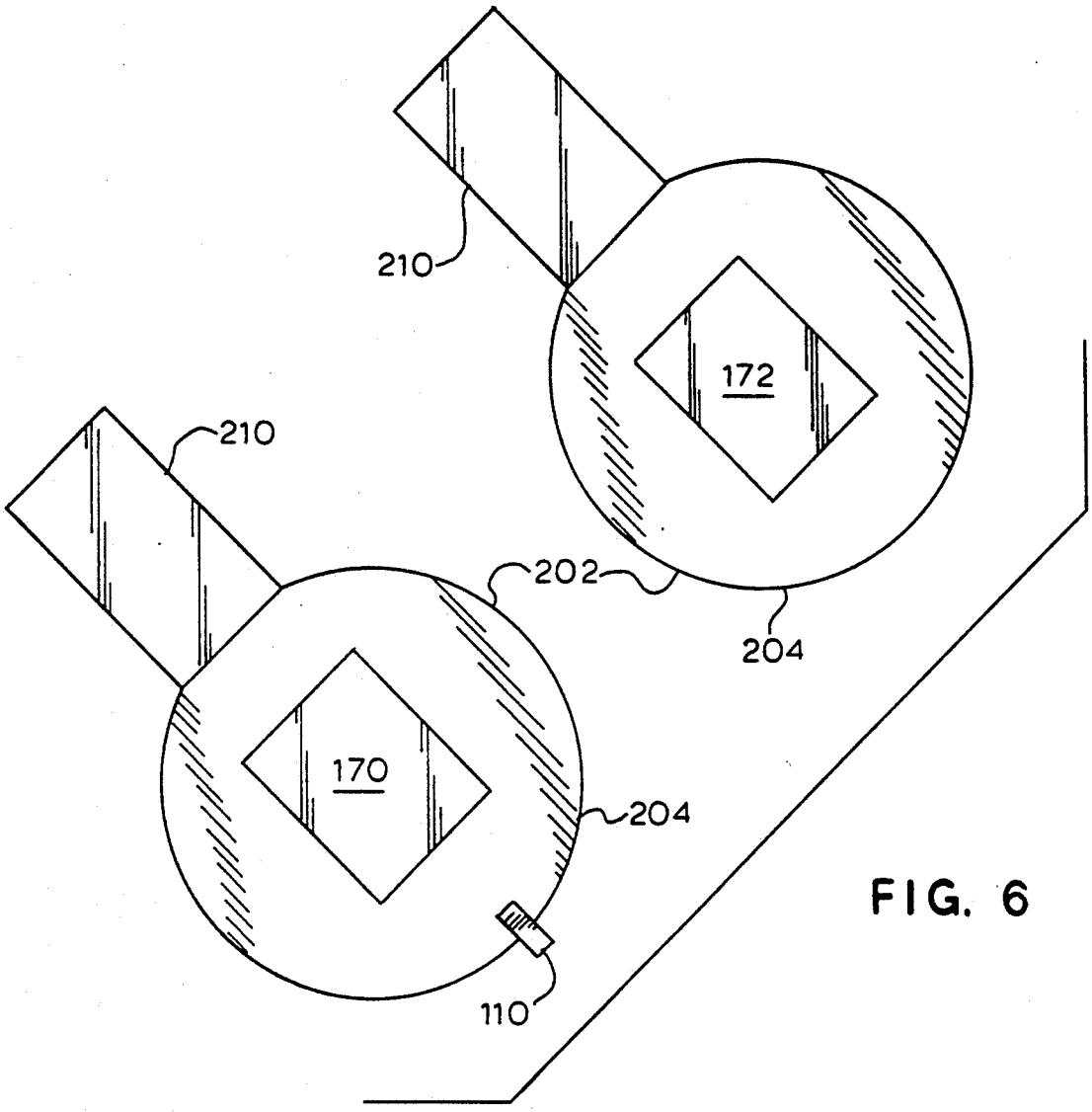
FIG. 6 depicts an exploded view of two-piece balloon 200 of this invention.

As depicted in FIG. 5 and FIG. 6, two-piece balloon 200 solves a number of these problems. A flap piece 202 has a body 204 and a pocket tab 210 extending therefrom. Flap piece 202 combines with a second flat piece 202 such each body 204 combines to form a combined balloon 208 and a pocket tab 210 extending therefrom. Pocket tab 210 is then forced into two-piece balloon 200. Then pocket flap 140 can be used to close the pocket slot 122. This procedure avoids sealing four layers and provides for simplified construction of the display device.

FIG. 2, FIG. 3 and FIG. 4 combine to depict the variety of items, which can be displayed in either two-piece balloon 200 or pocket balloon 100. Again pocket flap 140 has a double coated tape for tape sealed edge 144. When an article is placed inside either pocket tab 210 the inner pocket of the outer bag of the display device, the front side of the outer bag has a flap to which double sided tape is adhered.

Pocket flap 140 can therefore seal a display therein as long as is desired. Pocket flap 140 serves both to seal the pocket and article in either two-piece balloon 200 or pocket balloon 100. It also provides additional sealing for either balloon and the respective resulting pocket.

When the protective tab 146 is removed from the taped sealed edge 144, pocket flap 140 is then folded over, to seal either combined balloon 208 or pocket balloon 100. In this position, it both additionally seals the balloon and prevents any inner pocket from popping out of either balloon when inflated.

Either balloon can be mailed with ease in a deflated position with or without an article inserted in the inner pocket. The person receiving the balloon with the pocket can insert an article if necessary of choice in the pocket. The display device or balloon, because of its unique design, can than be sealed and inflated without the need of any special equipment.

FIG. 2, FIG. 3 and FIG. 4 further combine to depict automatical display of centered dimensional view of a variety of any article contained therein such as a photograph 250, a natural item such as flowers 252 or a manufactured item such as stuffed rabbit toy 254. These figures also illustrate that either bag may be tapered for flowers 252 or expanded for toy 254. The display is also multidimensional permitting a viewing of the article contained therein, from the front side, backside, or multiple sides.

Because of this disclosure of this invention, a plastic balloon shape may be used as a way of displaying an article, (for example a photograph) in simple, yet decorative manner, while requiring no special heat sealing equipment or vacuum pumps. The whole concept and application of this display device is used for a visual display indoors or outdoors similar to a dimensional glass enclosed picture frame. This device as disclosed has a wide variety of uses.

If it is desired to have a three dimensional display, a rectangular blister pack 256 for toy 254 in the shape of the pocket may be placed therein. Then whatever is desired may be inserted into rectangular blister pack 256, and thence into the pocket to avoid crushing the item, such as toy 254. This can be achieved for flowers 252 wherein the pocket is of a generally V-shaped. A pyramidal blister 260 can be used for flowers 252 (FIG. 4) or for other stuffed animals or similar decorations wherein crushing is a factor. This permitted three-dimensional display creates illusion similar to a ship-in-the-bottle illusion in a simple fashion. The pocket flap 140 also keeps rain and other foreign matter out of the balloon, which is especially useful in the outdoor display.

With a flat item such as a photgraph 250, this particular structure has only two films or layers between the viewer and the object contained in the pocket. Clearly, rectangular blister pack 256, or a similar structure if used, provides for three or more layers between the eyes and the object contained in the pocket. Either structure provides an efficient, clear way of displaying almost any item within the balloon. Of course, the balloon preferably contains a single, self-sealing valve 110 which permits inflating by air or helium.

Figure 7:
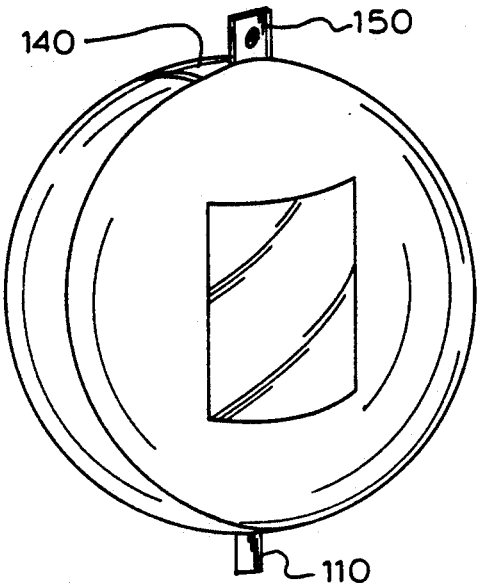

There is also an optional tab 150 shown in FIG. 7 on the top of the either balloon, which permits the balloon to be secured to a wall or other suitable surface for proper positioning. Tab 150 is usually opposite valve 110. In this fashion, the desired mounting of the decorative results can be obtained.

Figure 8:
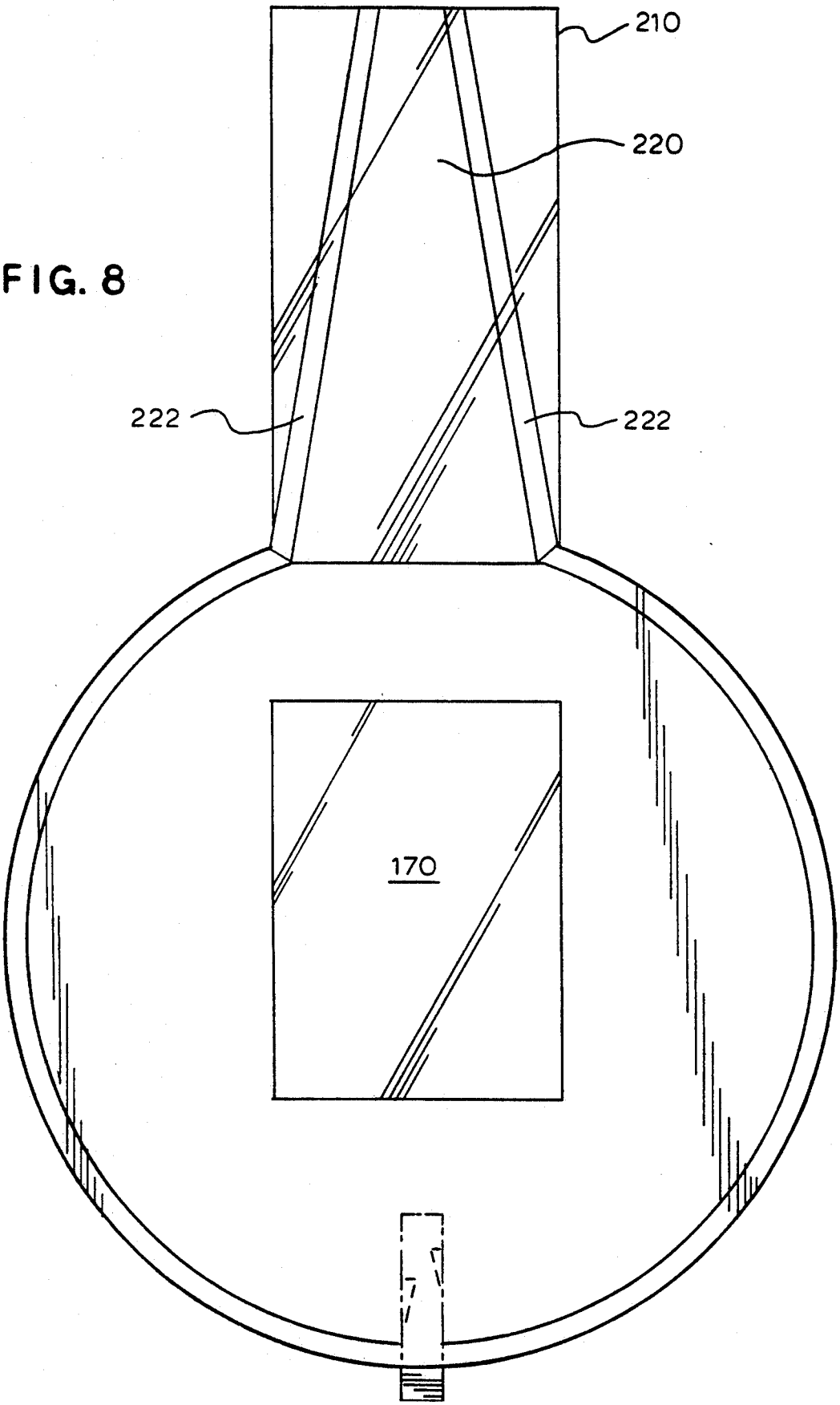
FIG. 8 depicts a front perspective view of assembled two-piece balloon 200 of this invention, having a pyramidal pocket 220.

FIG. 8 shows a modified pyramidal pocket 220. Pocket tab 210 is modified with tapered sides 222 to form pyramidal pocket 220 and receive, for example, flowers 252 or other pyramidal shape.

Either inner pocket in either balloon can both have a variety of different shapes, such as a rectangle, square, triangle and circle. The inner pocket does not necessarily have to have the same shape as the outer balloon. An example of this difference is that the outer balloon is circular and the inner pocket is rectanglar.

As shown in the drawings and particularly FIG. 7, this device is constructed with a plastic like material. Any sealable gas tight material is operable. There is a front view port 170 within either balloon. There may also be a rear view port 172 as shown in FIG. 2 and FIG. 6. Either balloon may be partially or totally transparent or translucent.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A display device having an inner section and an outer section comprising:

a) a first piece and a second piece being secured to each other;

b) said first piece and said second piece being substantially symmetrical and substantially transparent;

c) said first piece including a first body with a first pocket tab extending therefrom;

d) said second piece including a second body with a second pocket tab extending therefrom;

e) said first piece and said second piece being joined together at the edges thereof to form said outer section as an inflatable device;

f) a valve means for inflating the inflatable device connected with said inflatable device;

g) said first pocket tab and said second pocket tab combining to form a pocket as said inner section;

h) said pocket being folded within said inflatable device;

i) said first body and said second body combining to form said inflatable device and receiving said pocket;

j) a flap being secured to said first body adjacent said pocket;

k) said flap having sufficient size to extend over and cover said pocket; and l) said flap having releasable securing means to selectively seal said inner section across said pocket.

2. The display device of claim 1 further comprising:

a) said inner section removably receives an item;

b) said item is removably contained and sealed within said inner section.

3. The display device of claim 1, wherein said item is at least one selected from the group consisting of a decorative item, an informational item and a combination of an informational and decorative item.

4. The display device of claim 3, wherein said item is two-dimensional.

5. The display device of claim 4, wherein:

a) said two-dimensional item is at least one photograph; and b) said outer section includes at least one transparent portion to display said at least one photograph.

6. The display device of claim 3, wherein said item is three-dimensional.

7. The display device of claim 6, wherein:

a) said three-dimensional item is contained within a container means; and b) said container means is contained within said pocket.

8. The display device of claim 7, wherein said pocket is shaped to conform to said container means.

9. The display device of claim 7, wherein said item is a bunch of flowers.

10. The display device of claim 1, wherein:

a) said releasable sealing means is a flap;

b) said flap has a first edge portion secured to said outer section;

c) said first edge portion is permanently secured to said outer section;

d) said flap has a second edge portion secured to said outer section; and e) said second edge portion is removably secured to said outer section.

11. The display device of claim 10 wherein:

a) said edges combine to seal inner section and said item within said display device; and b) said display device is inflated as a balloon.

12. The display device of claim 11, wherein:

a) said outer section is inflatable; and b) said inner section lacks inflation capability.

13. The display device of claim 12, wherein:

a) said outer section includes a transparent portion to permit viewing of an inner portion; and b) said outer section includes a valve means for inflation.

* * * * *